US009753404B2

(12) United States Patent
Uchida et al.

(10) Patent No.: US 9,753,404 B2
(45) Date of Patent: Sep. 5, 2017

(54) POWDER CONTAINER AND IMAGE FORMING APPARATUS

(71) Applicant: FUJI XEROX CO., LTD., Tokyo (JP)

(72) Inventors: Masahiro Uchida, Kanagawa (JP); Manabu Furuki, Kanagawa (JP); Masashi Ikeda, Kanagawa (JP); Makoto Kamisaki, Kanagawa (JP); Tatsuhiro Igarashi, Kanagawa (JP); Teppei Yawada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/223,982

(22) Filed: Jul. 29, 2016

(65) Prior Publication Data

US 2017/0219955 A1 Aug. 3, 2017

(30) Foreign Application Priority Data

Jan. 28, 2016 (JP) ..... 2016-013882

(51) Int. Cl.
*G03G 15/08* (2006.01)

(52) U.S. Cl.
CPC ..... *G03G 15/0877* (2013.01)

(58) Field of Classification Search
CPC ..... G03G 15/0877
USPC ..... 399/262
See application file for complete search history.

(56) References Cited

U.S. PATENT DOCUMENTS

2005/0226655 A1* 10/2005 Katsuyama ..... G03G 15/0874 399/258
2011/0158662 A1 6/2011 Harashima et al.

FOREIGN PATENT DOCUMENTS

JP 2005-221852 A 8/2005
JP 2011-133681 A 7/2011

* cited by examiner

*Primary Examiner* — Susan Lee
(74) *Attorney, Agent, or Firm* — Oliff PLC

(57) ABSTRACT

A powder container includes a container chamber that contains powder; a transporting member that transports the powder in the container chamber; an opening that is provided in a wall of the container chamber and through which the powder is discharged out of the container chamber as the transporting member transports the powder; and a closing member that closes a lower portion of the opening and moves vertically relative to the opening in a direction opposite to a direction of vertical movement of the opening due to tilting of the container chamber.

8 Claims, 6 Drawing Sheets

POWDER CONTAINER AND IMAGE FORMING APPARATUS

CROSS-REFERENCE TO RELATED APPLICATIONS

This application is based on and claims priority under 35 USC 119 from Japanese Patent Application No, 2016-013882 filed Jan. 28, 2016.

BACKGROUND (i) Technical Field

The present invention relates to a powder container and an image forming apparatus.

(ii) Related Art

Electrophotographic image forming apparatuses are known. In an electrophotographic image forming apparatus, a toner cartridge that contains toner and a developing device that contains developer are examples of powder containers containing powder therein.

SUMMARY

According to an aspect of the invention, there is provided a powder container including a container chamber that contains powder; a transporting member that transports the powder in the container chamber; an opening that is provided in a wall of the container chamber and through which the powder is discharged out of the container chamber as the transporting member transports the powder; and a closing member that closes a lower portion of the opening and moves vertically relative to the opening in a direction opposite to a direction of vertical movement of the opening due to tilting of the container chamber.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described with reference to the drawings.

Figure 1:
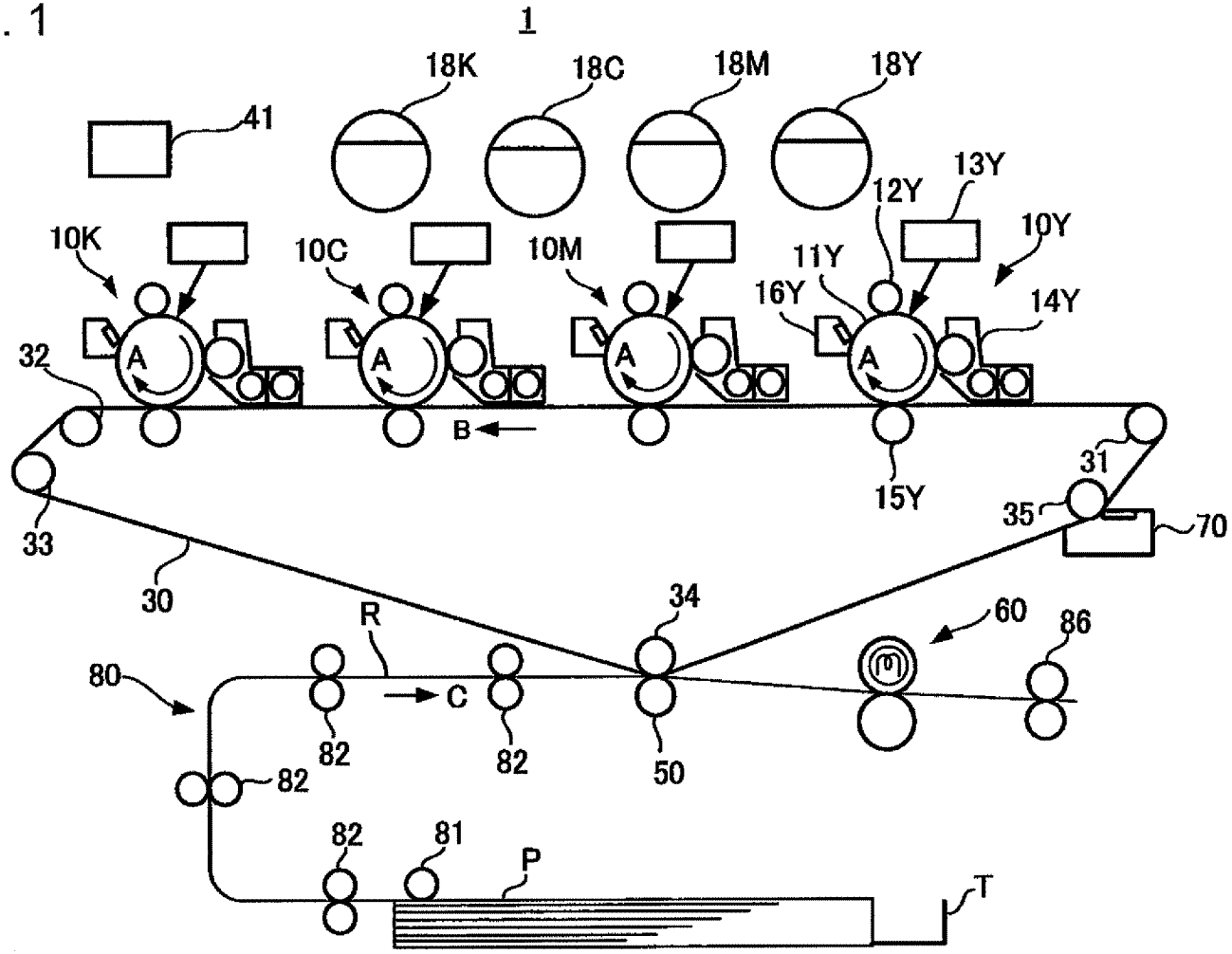
FIG. 1 illustrates the structure of an image forming apparatus according to an exemplary embodiment of the present invention.

FIG. 1 illustrates the structure of an image forming apparatus 1 according to an exemplary embodiment of the present invention.

The image forming apparatus 1 illustrated in FIG. 1 is a tandem-type color printer in which yellow (Y), magenta (M), cyan (C), and black (K) image engines 10Y, 10M, 10C, and 10K, which respectively form toner images of the respective colors in parallel, are arranged in tandem. The color printer is capable of printing monochrome images, and is also capable of printing full-color images by superposing the toner images of the four colors.

The image forming apparatus 1 includes toner cartridges 18Y, 18M, 18C, and 18K containing yellow (Y), magenta (M), cyan (C), and black (K) toners, which have a volume average particle diameter (D50v) in the range of, for example, 3 μm to 5 μm, or approximately 3 μm to approximately 5 μm. These toner cartridges 18Y, 18M, 18C, and 18K are examples of a coloring-material supplying device according to the present invention.

The image forming apparatus 1 also includes an intermediate transfer belt 30, a fixing device 60, a sheet transporting unit 80, and a controller 41 that controls each component of the image forming apparatus 1.

The four image engines 10Y, 10M, 10C, and 10K have the same structure except for the developer used therein; therefore, the yellow image engine 10Y will be explained as a representative example. The image engine 10Y includes a photoconductor 11Y, a charging device 12Y, an exposure device 13Y, a developing device 14Y, a first transfer device 15Y, and a photoconductor cleaner 16Y. Among these components, the components other than the exposure device 13Y and the first transfer device 15Y are assembled into a process cartridge. The process cartridges have the same structure.

The photoconductor 11Y includes a cylindrical body having a photosensitive material layer on the surface thereof, and rotates in the direction of arrow A, which is a direction around the axis of the cylindrical body, while carrying an image formed on the surface thereof. The charging device 12Y, the exposure device 13Y, the developing device 14Y, the first transfer device 15Y, and the photoconductor cleaner 16Y are arranged in that order around the photoconductor 11Y. The photoconductor 11Y is an example of an image carrier according to the present invention. The combination of the charging device 12Y and the exposure device 13Y is an example of a latent-image forming unit according to the present invention. The developing device 14Y is an example of a developing device according to the present invention, and is also a first example of a powder container according to the present invention.

The charging device 12Y charges the surface of the photoconductor 11Y by applying a bias voltage. The charging device 12Y according to the present exemplary embodiment is a charging roller that is in contact with the surface of the photoconductor 11Y. A voltage with the same polarity as the charging polarity of the toner in the developing device 14Y is applied to the charging roller, so that the charging roller charges the surface of the photoconductor 11Y that is in contact therewith. Instead of the charging roller, the charging device 12Y may be, for example, a corona discharge device that is not in contact with the photoconductor 11Y.

The exposure device 13Y performs an exposure process on the surface of the photoconductor 11Y by irradiating the photoconductor 11Y with a laser beam in accordance with an image signal for the corresponding color (yellow in this case). The image signal is generated by the controller 41 on the basis of image data supplied from the outside of the image forming apparatus 1. As a result of the exposure process performed by the exposure device 13Y, an electrostatic latent image is formed on the surface of the photoconductor 11Y. The exposure device 13Y may be an LED array, in which plural LEDs are arranged in a scanning direction, instead of the system using the laser beam.

The developing device 14Y forms a toner image by developing the electrostatic latent image on the surface of the photoconductor 11Y by using a developer containing toner. The developing device 14Y receives the toner from the toner cartridge 18Y through a supply path (not shown). The toner cartridge 18Y is a second example of a powder container according to the present invention. As described in detail below, the developing device 14Y is a trickle-type developing device in which part of the developer contained in the developing device 14Y is ejected little by little to refresh the magnetic carrier. A small amount of magnetic carrier is also supplied from the toner cartridge 18Y together with the toner. The developing device 14Y stirs the developer therein to charge the toner. An external additive may be added to the toner to improve the fluidity and chargeability of the toner.

The first transfer device 15Y faces the photoconductor 11Y with the intermediate transfer belt 30 interposed therebetween. A voltage with a polarity opposite to the charging polarity of the toner is applied to the first transfer device 15Y, so that the toner image on the photoconductor 11Y is electrostatically attracted to the intermediate transfer belt 30.

The photoconductor cleaner 16Y cleans the surface of the photoconductor 11Y after the transfer process by scraping off the residual toner, external additive, paper dust, etc., from the surface of the photoconductor 11Y with a cleaning blade that is in contact with the surface of the photoconductor 11Y.

The intermediate transfer belt 30 is an endless belt provided around the belt support rollers 31 to 35, and is rotated in the direction of arrow B via the image engines 10Y, 10M, 10C, and 10K and a second transfer device 50. The toner images of the respective colors formed by the image engines 10Y, 10M, 10C, and 10K are transferred onto the intermediate transfer belt 30 in a superposed manner, so that a color toner image is formed. The intermediate transfer belt 30 rotates in the direction of arrow B while carrying the toner image, and transports the toner image to the second transfer device 50.

In the sheet transporting unit 80, a sheet P contained in a sheet container T is picked up by a pick-up roller 81 and transported in the direction of arrow C to the second transfer device 50 along a sheet transport path R by transport rollers 82.

The second transfer device 50 is a roller that rotates while the intermediate transfer belt 30 and the sheet are sandwiched between the roller and a backup roller 34, which is one of the belt support rollers 31 to 35. A voltage with a polarity opposite to the charging polarity of the toner is applied to the second transfer device 50, so that the toner image on the intermediate transfer belt 30 is electrostatically attracted to the sheet and an unfixed toner image is formed on the sheet.

A belt cleaner 70 brings a blade into contact with the intermediate transfer belt 30 that has passed through the second transfer device 50, thereby scraping off the toner, external additive, paper dust, etc., from the intermediate transfer belt 30.

The fixing device 60 fixes the unfixed toner image to the sheet by applying heat and pressure.

The sheet with the toner image fixed thereto is ejected to the outside of the apparatus by an output roller 86, which is a component of the sheet transporting unit 80.

The developing device and the toner cartridge will be further described. In the following description, the characters representing the colors, that is, 'Y', 'M', 'C', and 'K', attached to the reference numerals are omitted.

Figure 2:
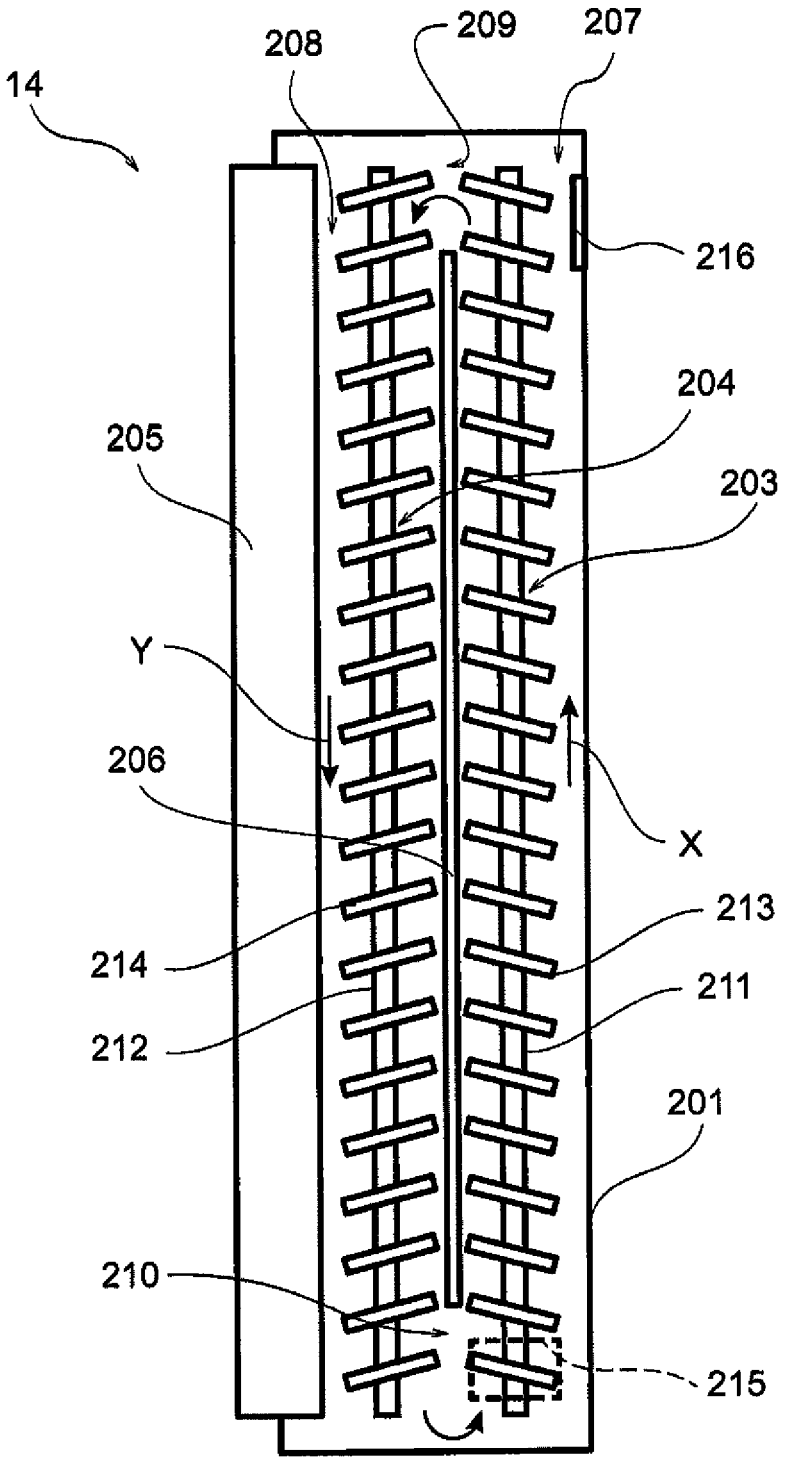
FIG. 2 is a top view illustrating the interior of a developing device illustrated in FIG. 1.

FIG. 2 is a top view illustrating the interior of a developing device illustrated in FIG. 1.

The developing device 14 includes a developer containing chamber 201 that contains the developer therein, two transporting members 203 and 204 that extend parallel to each other, and a developing roller 205 that extends parallel to the transporting members 203 and 204 and rotates in a direction perpendicular to the transporting members 203 and 204. The developer containing chamber 201 is an example of a container chamber according to the present invention.

The developing roller 205 includes a magnet disposed therein, and rotates while attracting the developer to the surface thereof with a magnetic force, thereby carrying the developer from the developer containing chamber 201 to a developing position at which the developing roller 205 faces the photoconductor 11. The latent image is developed at the developing position. After the developing process, the developer is returned to the developer containing chamber 201 by the rotation of the developing roller 205.

A separation wall 206 is disposed between the two transporting members 203 and 204 in the developer containing chamber 201, so that the developer containing chamber 201 is divided into two sections 207 and 208. The separation wall 206 has openings 209 and 210 at both ends thereof in the long-side direction.

The two transporting members 203 and 204 include circular rod-shaped rotating shafts 211 and 212, and helical blades 213 and 214 that extend helically around the rotating shafts 211 and 212 in the direction in which the rotating shafts 211 and 212 extend. The transporting members 203 and 204 rotate so as to transport the developer, and are an example of a conveying member according to the present invention. The first transporting member 203 transports the developer in the first section 207 in the direction of arrow X while stirring the developer. The second transporting member 204 transports the developer in the second section 208, which is adjacent to the developing roller 205, along the developing roller 205 in the direction of arrow Y while stirring the developer. The developer transported in the direction of arrow X passes through the first opening 209 and enters the second section 208, and the developer transported in the direction of arrow Y passes through the second opening 210 and enters the first section 207. Thus, the developer in the developer containing chamber 201 is circulated while being stirred by the two transporting members 203 and 204. As described above, the toner contained in the developer is charged when the developer is stirred.

An inlet 215 for the toner supplied from the toner cartridge 18 is formed in the top surface of the first section 207 at the most upstream location in the developer transporting direction. The toner flowed into the developing device 14 through the inlet 215 is transported by the first transporting member 203 while being stirred, and is thereby mixed with the developer.

The developing device 14 includes a TC sensor that measures a toner-to-carrier (TC) ratio of the developer that circulates in the developer containing chamber 201. Based on the measurement value obtained by the TC sensor, the controller 41 issues an instruction for supplying the toner from the toner cartridge 18 so that the TC ratio of the developer is maintained constant.

An outlet 216 is formed in a wall of the first section 207 of the developer containing chamber 201 at the most downstream location in the developer transporting direction. most of the developer transported in the direction of arrow X in the first section 207 enters the second section 208 through the first opening 209. However, some of the developer is discharged through the outlet 216, so that the developer in the developing device 14 is refreshed. As described below, the outlet 216 is provided with a shutter member so that the amount of developer that is discharged does not easily vary even when the developing device 14 is tilted. The outlet 216 is an example of an opening according to the present invention.

The present exemplary embodiment and a comparative example will be described.

Figure 3:
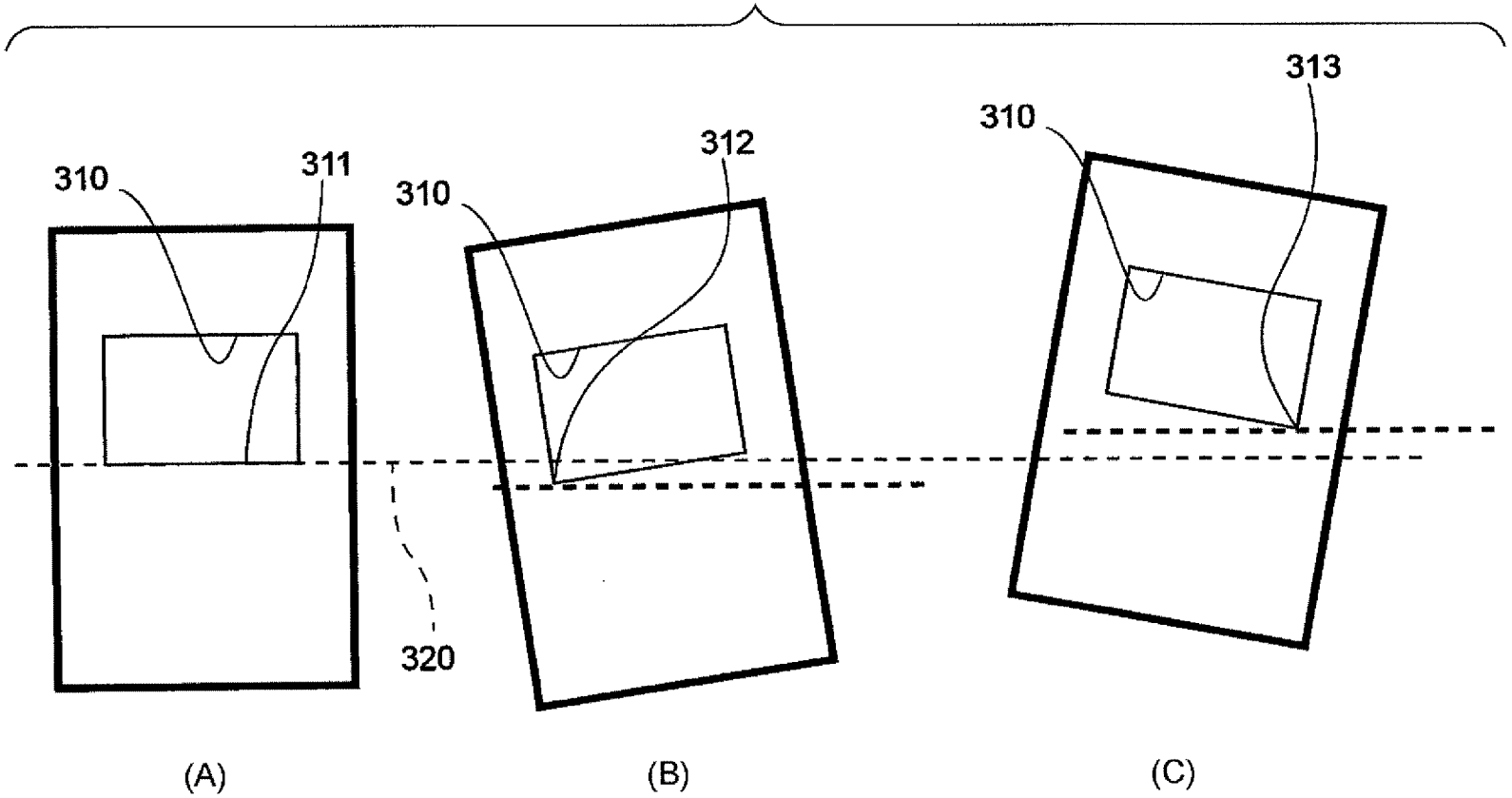
FIG. 3 RELATED ART
FIG. 3 illustrates the influence of tilting according to a comparative example.

FIG. 3 illustrates the influence of tilting according to the comparative example.

In the comparative example, an outlet 310, which is a simple opening, is provided at a position corresponding to the position of the above-described outlet 216, and tilting of the installation surface is not compensated for. FIG. 3 illustrates only the region around the outlet 310.

Part (A) of FIG. 3 illustrates the state in which the developer containing chamber 201 illustrated in FIG. 2 is arranged horizontally. In this state, the bottom side 311 of the outlet 310 is horizontal, and the height of the bottom side 311 is the same as that of a designed horizontal reference line 320. As a result, the designed amount of developer is gradually discharged from the outlet 310, and the developer is appropriately refreshed.

Part (B) of FIG. 3 illustrates the state in which the developer containing chamber 201 is tilted in the long-side direction. Assume that the developer containing chamber 201 is tilted such that the end near the outlet 310 is moved downward. In this case, one corner 312 of the outlet 310 is at the lowermost position, and the corner 312 is below the designed horizontal reference line 320. As a result, the amount of developer discharged from the outlet 310 is greater than the designed amount, and the amount of developer in the developer containing chamber 201 decreases at a rate higher than the designed rate. Therefore, the toner is supplied from the toner cartridge 18 at a rate higher than the designed rate. Accordingly, the toner in the toner cartridge 18 runs out in a period shorter than the designed period, and the toner cartridge 18 needs to be replaced at a time earlier than the designed time. Even when the developer containing chamber 201 is only slightly tilted from the horizontal, the period of use considerably decreases. This leads to, for example, an increase in the running cost.

Part (C) of FIG. 3 illustrates the state in which the developer containing chamber 201 is tilted in a direction opposite to the tilting direction in part (B). In this state, the other corner 313 of the outlet 310 is at the lowermost position, but the corner 313 is above the designed horizontal reference line 320. As a result, the amount of developer discharged from the outlet 310 is less than the designed amount. Therefore, the developer in the developer containing chamber 201 is not appropriately refreshed, and degradation of the developer progresses at a rate higher than the designed rate. This leads to a reduction in the image quality.

Unlike the comparative example, in the present exemplary embodiment, a structure for compensating for the tilting is provided.

Figure 4:
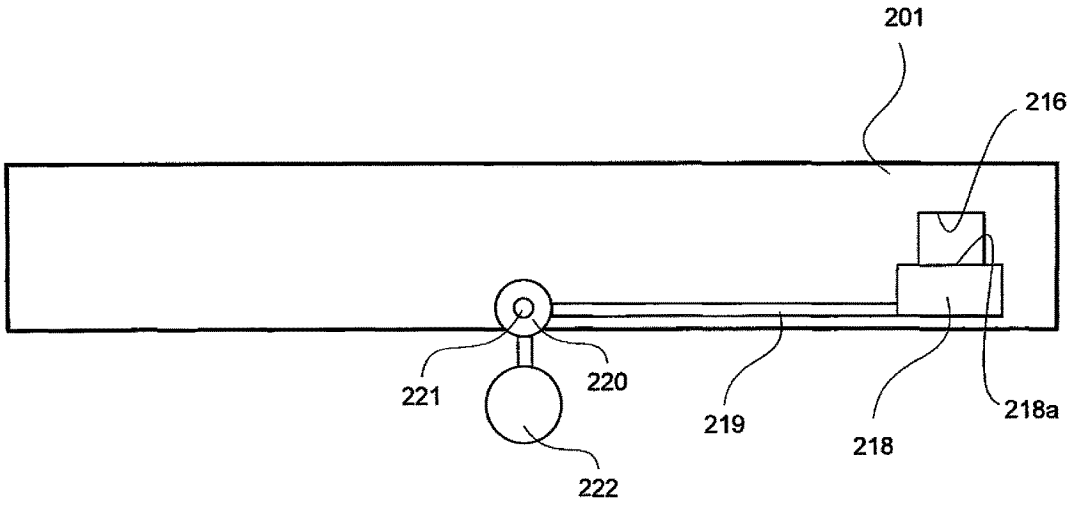
FIG. 4 illustrates a structure for compensating for the tilting.

FIG. 4 illustrates a structure for compensating for the tilting.

As an example, FIG. 4 illustrates a structure for compensating for tilting of the developer containing chamber 201 in the long-side direction.

The above-described outlet 216 is formed in the wall of the developer containing chamber 201, and a lower portion of the outlet 216 is closed by a shutter member 218 that is movable in the vertical direction. Therefore, the top side 218*a* of the shutter member 218 substantially serves as the bottom side of the outlet 216.

The shutter member 218 is fixed to an end of an arm member 219. The arm member 219 is integrated with a rotating member 220 that is rotatable around a fulcrum 221. The arm member 219 extends from the rotating member 220 in the long-side direction of the developer containing chamber 201. The fulcrum 221 is fixed to the wall of the developer containing chamber 201.

A weight member 222 projects from the rotating member 220 in a direction different from the direction in which the arm member 219 extends. The weight member 222 is much heavier than the shutter member 218 and the arm member 219 combined together. The shutter member 218 is raised to a height where the shutter member 218 covers the lower portion of the outlet 216 as a result of the weight member 222 being moved downward due to the self-weight thereof.

The shutter member 218 is an example of a closing member according to the present invention, and the rotating member 220 is an example of a rotating member according to the present invention. The arm member 219 is an example of a holding member according to the present invention, and the weight member 222 is an example of a weight according to the present invention. In the present exemplary embodiment, the fulcrum 221 is disposed approximately at the center of the developer containing chamber 201 in the long-side direction. However, the position of the fulcrum according to the present invention is not particularly limited as long as the fulcrum is closer to the center than the outlet is. For example, the fulcrum may instead be fixed at the middle point between the outlet 216 and the fulcrum 221 illustrated in FIG. 4.

The structure illustrated in FIG. 4 functions as follows to compensate for the tilting.

Figure 5:
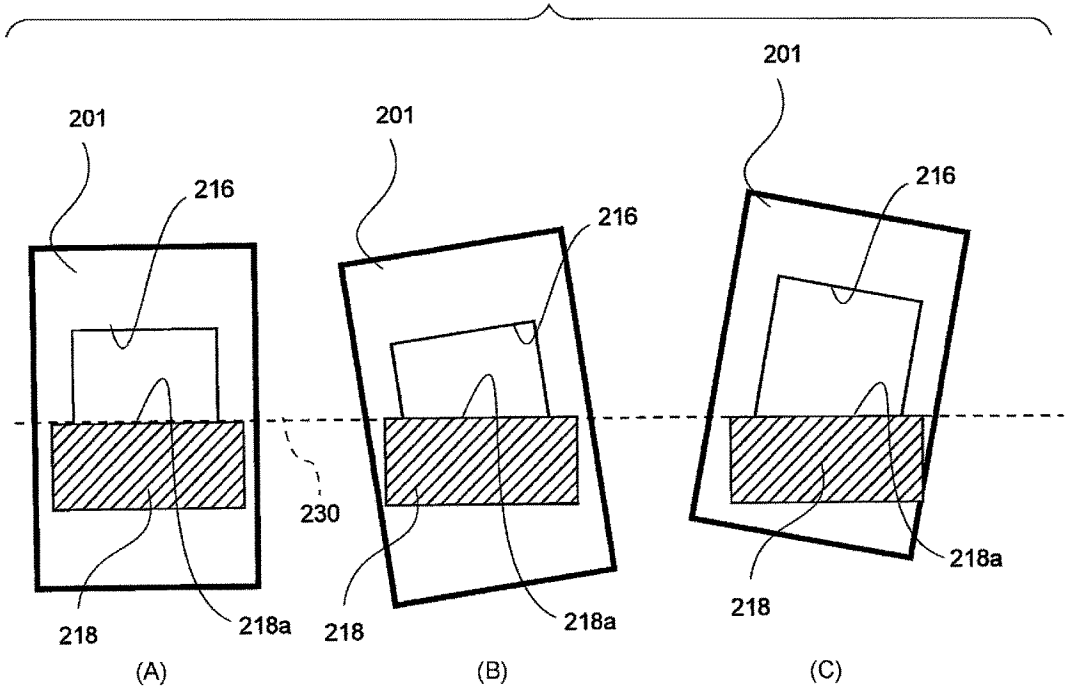
FIG. 5 illustrates the manner in which the tilting is compensated for by the structure illustrated in FIG. 4.

FIG. 5 illustrates the manner in which the tilting is compensated for by the structure illustrated in FIG. 4.

Similar to FIG. 3, FIG. 5 illustrates only the region around the outlet 216 of the developer containing chamber 201.

Part (A) of FIG. 5 illustrates the state in which the developer containing chamber 201 is arranged horizontally. In this state, the lower portion of the outlet 216 is closed by the shutter member 218, and the height of the top side 218*a* of the shutter member 218, which substantially serves as the bottom side of the outlet 216, is the same as that of a designed horizontal reference line 230. As a result, the designed amount of developer is gradually discharged from the outlet 216, and the developer is appropriately refreshed.

Part (B) of FIG. 5 illustrates the state in which the developer containing chamber 201 is tilted in the long-side direction. Assume that the developer containing chamber 201 is tilted such that the end near the outlet 216 is moved downward. In this case, since the shutter member 218 is balanced with the weight member 222 illustrated in FIG. 4, the height of the top side 218*a* of the shutter member 218 is maintained substantially the same as the height of the horizontal reference line 230. In other words, when the outlet 216 is moved downward due to the tilting of the developer containing chamber 201, the shutter member 218 moves upward relative to the outlet 216. As a result, even when the tilting occurs, the designed amount of developer is discharged from the outlet 216, and the developer is appropriately refreshed.

Part (C) of FIG. 5 illustrates the state in which the developer containing chamber 201 is tilted in a direction opposite to the tilting direction in part (B). Also in this case, the shutter member 218 is balanced with the weight member 222, so that the height of the top side 218*a* of the shutter member 218 is substantially the same as the height of the horizontal reference line 230. In other words, when the outlet 216 is moved upward due to the tilting of the developer containing chamber 201, the shutter member 218 moves downward relative to the outlet 216. As a result, also when the tilting illustrated in part (C) occurs, the designed amount of developer is discharged from the outlet 216, and the developer is appropriately refreshed.

Thus, the shutter member 218 moves in a direction opposite the direction of the vertical movement of the outlet 216. Accordingly, the height of the bottom side of the outlet 216 is substantially maintained, and the amount of developer discharged from the outlet 216 is maintained. In the structure illustrated in FIG. 4, the fulcrum 221 is disposed approximately at the center of the developer containing chamber 201. Therefore, the height of the top side 218*a* of the shutter member 218 is substantially the same as the height of the horizontal reference line 230. However, even when the fulcrum 221 is closer to the outlet 216, a change in height of the shutter member 218 may be reduced, and accordingly a change in the amount of developer that is discharged may be reduced. When the structure illustrated in FIG. 4 in which the weight member 222 is balanced with the shutter member 218 is used, variation in the amount of developer discharged may be suppressed with a simple structure. However, a similar variation suppressing effect may also be obtained by driving the shutter member 218 with, for example, an actuator so that the shutter member 218 is moved vertically as described above with reference to FIG. 5.

The top side of the shutter member (bottom side of the outlet) may be maintained substantially horizontal to control the flow rate of the powder.

In the image forming apparatus 1 according to the present exemplary embodiment, the toner cartridge 18 also has a structure for compensating for tilting.

Figure 6:
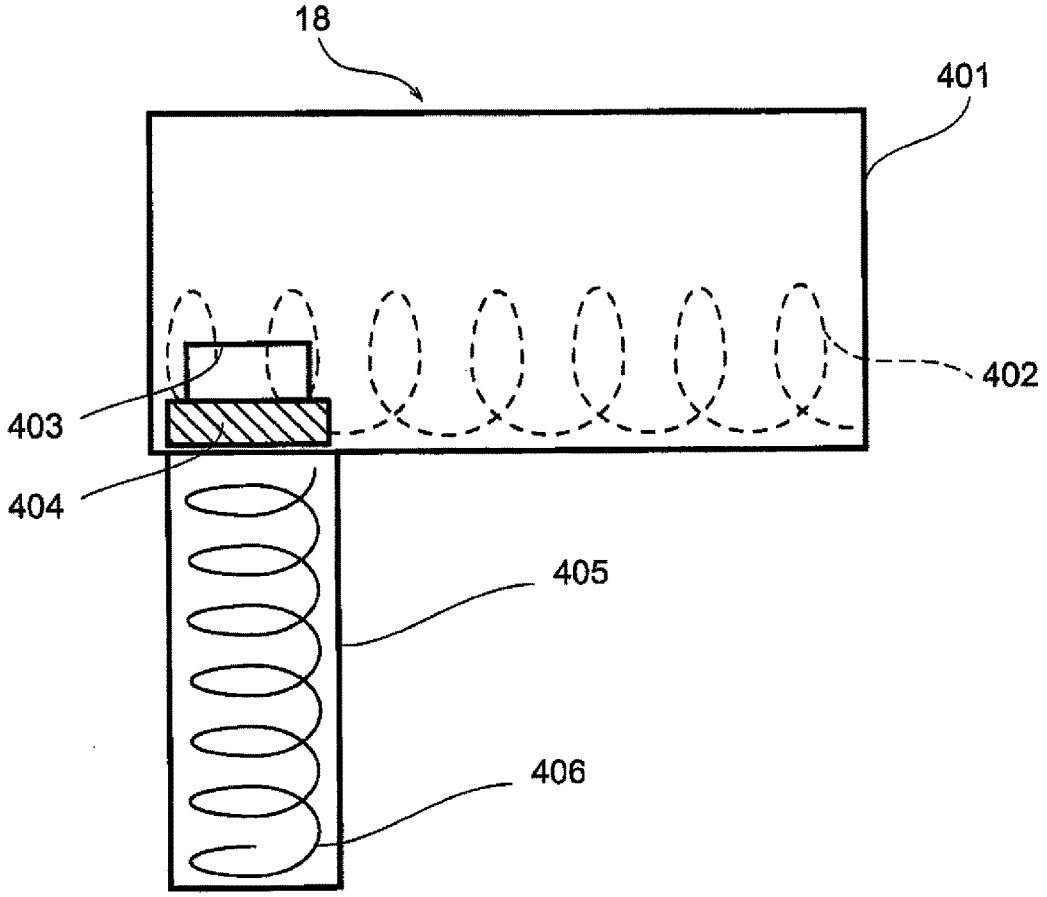
FIG. 6 illustrates a structure for compensating for tilting of a toner cartridge.

FIG. 6 illustrates a structure for compensating for tilting of the toner cartridge 18.

The toner cartridge 18 includes a toner container 401 that contains toner. A transporting member 402 that transports the toner in the toner container 401 is disposed in the toner container 401. The transporting member 402 is a helically wound linear metal member, and is rotated around a helical axis to transport the toner. A toner outlet 403 is formed in a wall of the toner container 401 at a downstream position in the transporting direction of the transporting member 402. The toner that has been transported by the transporting member 402 is discharged to the outside of the toner container 401 through the toner outlet 403. The toner that has been discharged out of the toner container 401 is supplied to the developing device 14 through a toner supply path 405, which is connected to the inlet 215 of the developing device 14 illustrated in FIG. 2. The toner supply path 405 also has a helical transporting member 406 disposed therein, and the transporting member 406 is rotated to transport the toner along the toner supply path 405.

The toner outlet 403 of the toner cartridge 18 also moves vertically when the toner container 401 is tilted in the long-side direction. Therefore, unless the tilting is compensated for, the amount of toner supplied to the developing device 14 may differ from the designed amount due to the influence of tilting illustrated in FIG. 3.

Accordingly, in the present exemplary embodiment, a shutter member 404 that closes a lower portion of the toner outlet 403 is provided. The shutter member 404 is held by a structure similar to the structure illustrated in FIG. 4, and moves vertically relative to the toner outlet 403 in accordance with the tilt of the toner container 401. As a result, the amount of toner discharged from the toner outlet 403 is close to the designed amount irrespective of the tilt of the toner container 401, and excessive or insufficient toner supply is prevented.

The toner container 401 is an example of a container chamber according to the present embodiment, the transporting member 402 an example of a transporting member according to the present invention, the toner outlet 403 an example of an opening according to the present invention, and the shutter member 404 an example of a closing member according to the present invention.

Although the structures for compensating for tilting of the toner container 401 and the developer containing chamber 201 in the long-side direction are described above, structures for compensating for tilting of the toner container 401 and the developer containing chamber 201 in the short-side direction may also be provided.

Figure 7:
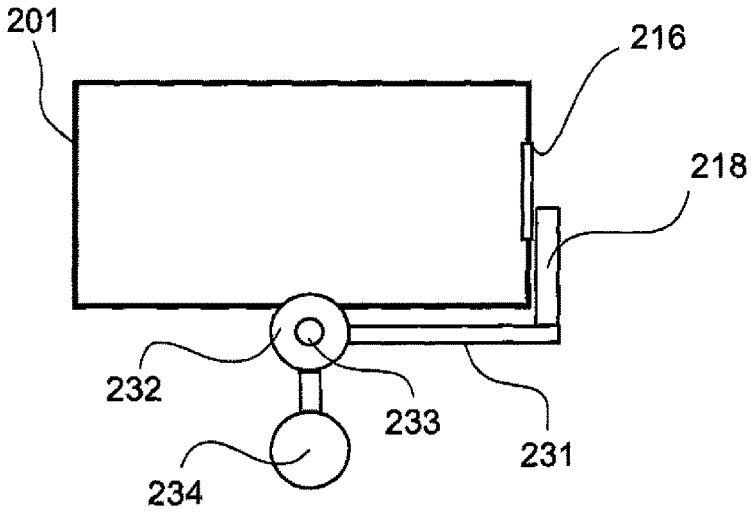
FIG. 7 illustrates a structure for compensating for tilting in a short-side direction.

FIG. 7 illustrates a structure for compensating for tilting in a short-side direction.

As an example, FIG. 7 illustrates a structure for compensating for tilting of the developer containing chamber 201. In FIG. 7, the developer containing chamber 201 is viewed from one end in the long-side direction.

The above-described outlet 216 is formed in the wall of the developer containing chamber 201, and the lower portion of the outlet 216 is closed by the shutter member 218.

The shutter member 218 is fixed to an end of an arm member 231 that extends in the short-side direction of the developer containing chamber 201. The arm member 231 extends from the rotating member 232. The rotating member 232 is rotatable around a fulcrum 233 fixed to the developer containing chamber 201. A weight member 234 projects from the rotating member 232 in a direction different from the direction in which the arm member 231 extends. The arm member 231 and the shutter member 218 are raised due to the self-weight of the weight member 234, and the shutter member 218 is maintained at a height at which the shutter member 218 closes the lower portion of the outlet 216.

With the above-described structure, the height of the shutter member 218 is maintained even when the developer containing chamber 201 is tilted in the short-side direction. Accordingly, the amount of developer discharged from the outlet 216 is maintained.

Furthermore, although a tandem-type image forming apparatus including plural image carriers is described above as an example of an image forming apparatus, the image forming apparatus according to the present invention may instead be a revolver-type image forming apparatus in which toner images of respective colors are formed on a single image carrier.

Furthermore, although a color printer is described above as an example of an image forming apparatus, the image forming apparatus according to the present invention may instead be a monochrome printer. Alternatively, the image forming apparatus may be a facsimile machine, a copy machine, or a multifunction machine.

Furthermore, although an indirect-transferring image forming apparatus including an intermediate transfer belt is described above as an example of an image forming apparatus, the image forming apparatus according to the present invention may instead be a direct transferring image forming apparatus in which the toner images are directly transferred onto a sheet of paper from an imager carrier.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder container comprising:

a container chamber that contains powder;

a transporting member that transports the powder in the container chamber;

an opening that is provided in a wall of the container chamber and through which the powder is discharged out of the container chamber as the transporting member transports the powder; and a closing member that closes a lower portion of the opening and moves vertically relative to the opening in a direction opposite to a direction of vertical movement of the opening due to tilting of the container chamber.

2. The powder container according to claim 1, further comprising:

a rotating member rotatable around a fulcrum located closer to a center of the container chamber than the opening is;

a holding member that extends from the rotating member and holds the closing member; and a weight that extends from the rotating member in a direction different from a direction in which the holding member extends, the weight moving downward due to a self-weight thereof to raise the closing member to a height at which the closing member closes the lower portion of the opening.

3. The powder container according to claim 1, wherein the powder is toner.

4. The powder container according to claim 3, wherein the toner has a volume average particle diameter (D50v) in a range of approximately 3 μm to approximately 5 μm.

5. An image forming apparatus comprising:

an image carrier;

a latent-image forming unit that forms a latent image on a surface of the image carrier;

a developing device that develops the latent image with a powdered coloring material; and a coloring-material supplying device that supplies the coloring material to the developing device, wherein at least one of the developing device or the coloring-material supplying device includes a container chamber that contains powder, a transporting member that transports the powder in the container chamber, an opening provided in a wall of the container chamber and through which the powder is discharged out of the container chamber as the transporting member transports the powder, and a closing member that closes a lower portion of the opening and moves vertically relative to the opening in a direction opposite to a direction of vertical movement of the opening due to tilting of the container chamber.

6. The image forming apparatus according to claim 5, wherein the at least one of the developing device or the coloring-material supplying device further includes a rotating member rotatable around a fulcrum located closer to a center of the container chamber than the opening is, a holding member that extends from the rotating member and holds the closing member, and a weight that extends from the rotating member in a direction different from a direction in which the holding member extends, the weight moving downward due to a self-weight thereof to raise the closing member to a height at which the closing member closes the lower portion of the opening.

7. The image forming apparatus according to claim 5, wherein the powder is toner.

8. The image forming apparatus according to claim 7, wherein the toner has a volume average particle diameter (D50v) in a range of approximately 3 μm to approximately 5 μm.

* * * * *